US005094094A

United States Patent [19]

Muramatsu et al.

[11] Patent Number: 5,094,094

[45] Date of Patent: Mar. 10, 1992

[54] HOT-ROLLING EQUIPMENT AND A METHOD OF HOT-ROLLING A SLAB

[75] Inventors: Yutaka Muramatsu, Ibaraki; Sadayoshi Tajima, Hitachi, both of Japan

[73] Assignee: Hitachi, Ltd., Tokyo, Japan

[21] Appl. No.: 433,153

[22] Filed: Nov. 9, 1989

[30] Foreign Application Priority Data

Nov. 11, 1988 [JP] Japan ..... 63-285383

[51] Int. Cl.[5] ..... B21B 1/46

[52] U.S. Cl. ..... 72/200; 72/202; 29/527.7

[58] Field of Search ..... 29/527.7; 72/200, 202, 72/365, 366

[56] References Cited

U.S. PATENT DOCUMENTS 3,648,359 3/1972 Dennis ..... 29/527.7

FOREIGN PATENT DOCUMENTS 56-74304 6/1981 Japan ..... 72/202
56-91908 7/1981 Japan ..... 72/200
58-16707 1/1983 Japan ..... 72/200
59-101201 6/1984 Japan .
60-115302 6/1985 Japan .
60-180601 9/1985 Japan ..... 29/527.7
61-235002 10/1986 Japan ..... 29/527.7

*Primary Examiner*—Lowell A. Larson
*Assistant Examiner*—Michael J. McKeon
*Attorney, Agent, or Firm*—Fay, Sharpe, Beall, Fagan, Minnich & McKee

[57] ABSTRACT

A hot-rolling equipment installation has a continuous casting apparatus linearly arranged with a simplified heating oven disposed uimmediately after an outlet of the continuous casting apparatus, a sizing press disposed immediately after an outlet of the simplfied heating oven, and rough rolling mills. The sizing press is installed at an inlet side of the rough rolling mills. The slab material is transferred from the continuous casting apparatus to the simplified heating oven and then reduced in width by the sizing press. The simplified heating oven raises the temperature of the edge portions of the slab so that the edge and center portions of the slab are made uniform in temperature. This prevents the edges from cracking during width reduction and subsequent rolling in the rough rolling mills.

9 Claims, 2 Drawing Sheets

HOT-ROLLING EQUIPMENT AND A METHOD OF HOT-ROLLING A SLAB

BACKGROUND OF THE INVENTION

The present invention relates to hot-rolling equipment and a method of hot-rolling a slab and, more particularly, to hot-rolling equipment and method in which a sizing press intended to reduce the width of a slab plate is provided at an inlet side of rough rolling mills, and the slab material transferred from a continuous casting apparatus is subjected to reduction in width, after which the resulting slab is rolled.

With a recent standardization of slab material width for continuous casting apparatus, there has been a demand for changing the width of slab plate in the succeeding rolling step. To satisfy this demand, such a sizing press as disclosed in Japanese Patent Unexamined Publication No. 59-101201 has been adopted. This sizing press has a pair of press tool parts or mold parts which reciprocate laterally with respect to the travelling direction of a slab to press the same in the widthwise direction. Thus, the slab can be greatly reduced in width. An example of hot-rolling equipment with such a sizing press is in Japanese Patent Unexamined Publication No. 60-115302. In this hot-rolling equipment, the sizing press is disposed between a heating over and a finish rolling mill. The slab material, which has been once cooled during its transfer from the continuous casting apparatus, is heated by the heating oven up to a temperature of 1100° C. or more which permits hot-rolling. Thereafter, the slab is transferred to the sizing press in which it is subjected to reduction in width. Thereafter, the slab is hot-rolled by the finish rolling mill.

In the above-described conventional hot-rolling equipment, the press tool of the sizing press contacts the slab which is kept at a temperature as high as 1100° C. or more for pressing fabrication. Usually, therefore, the press tool is water-cooled down to a temperature of 500° C. or 600° C. or less so as to ensure heat-resistant strength. Accordingly, a high temperature difference acts on the portions of contact between side edges of the slab and the press tool parts, so that the slab is cooled only at its side edges. This raises, for example, a problem that, in the succeeding rolling step, side edge cracks, non-uniformity in temperature in the widthwise direction, etc. occur with the result that a decrease in the thickness precision in the widthwise direction (tendency for a central part of slab to extend) occurs.

SUMMARY OF THE INVENTION

An object of the present invention is to prevent the occurrence of side edge cracks of the slab during the rolling operation performed with hot-rolling equipment in which the slab width is reduced and thereafter the slab is rolled.

Another object of the present invention is to reduce the space that the hot-rolling mill installation occupies, thereby enabling a reduction or savings of energy, as well as enabling a reduction equipment in cost.

To attain the above objects, the present invention provides hot-rolling equipment which comprises a sizing press disposed at the inlet side of the rough rolling mill to reduce the width of a slab. The slab is transferred from a continuous casting apparatus, passed through the sizing press and then rolled. A simplified heating oven is disposed immediately after an outlet of the continuous casting apparatus and the sizing press is installed immediately after an outlet of the simplified heating oven. The continuous casting apparatus, simplified heating oven, sizing press and rough rolling mills are linearly arranged whereby a high temperature slab material produced in the continuous casting apparatus is reduced in width by the sizing press.

Further, the present invention provides a hot-rolling method for a slab which heats the slab fed from the continuous casting apparatus in the simplified heating oven installed immediately after the outlet of the continuous casting apparatus, and reduces the width of the slab thus heated in the sizing press installed immediately after the outlet of the simplified heating oven.

DESCRIPTION OF THE PREFERRED EMBODIMENTS

Figure 1A:
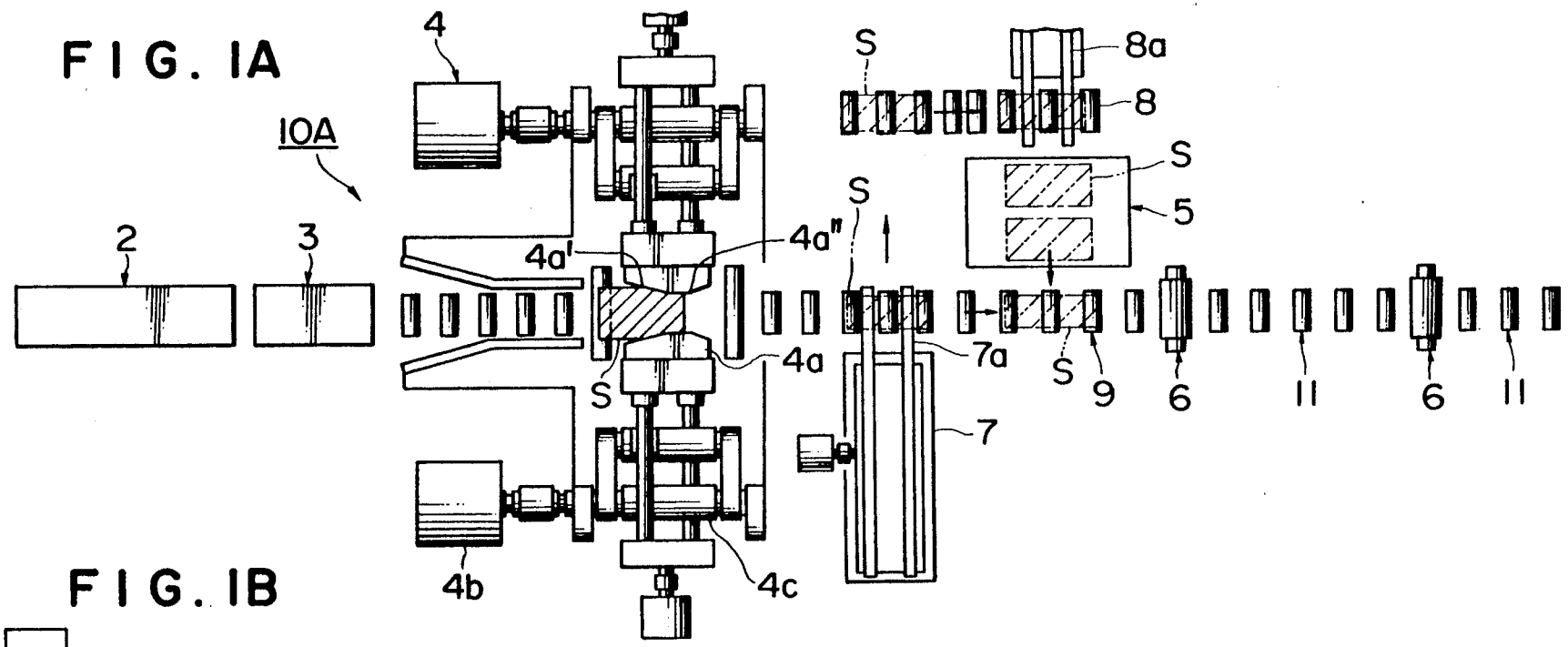
FIG. 1A is a plan view of the hot-rolling equipment constructed in accordance with a first embodiment of the present invention.
Figure 1B:
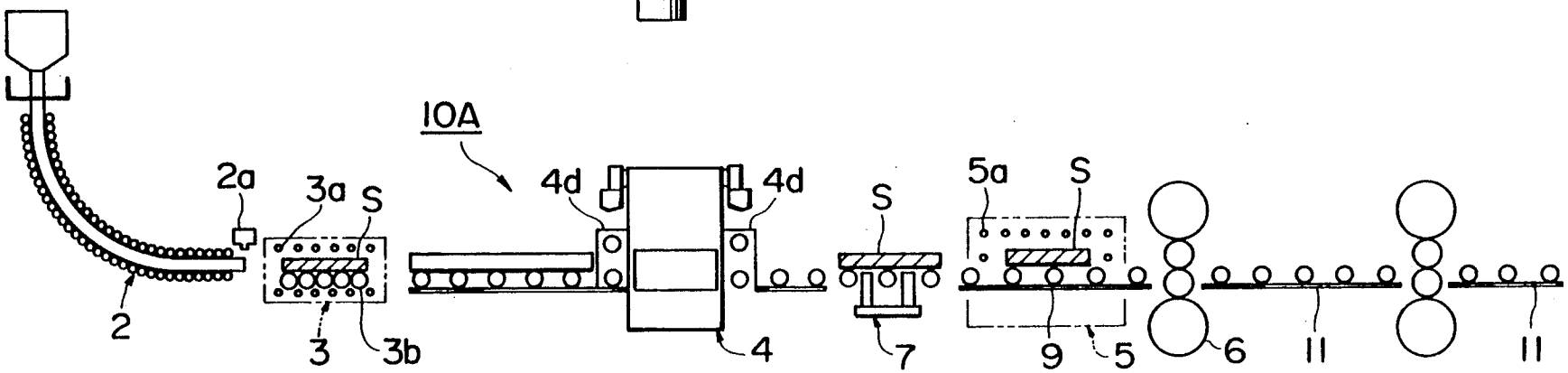
FIG. 1B is a side view of the hot-rolling equipment shown in FIG. 1A.

Referring to FIGS. 1A and 1B, hot-rolling equipment (10A) constructed in accordance with a first embodiment of the present invention is shown. This hot-rolling equipment (10A) is composed of a steel-making section and a rolling section. The steel-making section is constituted by a continuous casting apparatus (2) while the rolling section contains a simplified heating oven (3) disposed immediately after an outlet of the continuous casting apparatus, a sizing press (4) disposed immediately after an outlet of the simplified heating oven, a reheating oven (5) disposed immediately after an outlet of the sizing press, and a plurality of rough rolling mills (6) disposed at the outlet side of the reheating oven. The simplified heating oven (3) prevents a decrease in temperature of the high-temperature slab material S produced in the continuous casting apparatus (2), or to reheat the slab plate to its original temperature after it has experienced a temperature drop. The sizing press (4) reduces the width of the slab S which has been drawn out of the simplified heating oven (3). The reheating oven (5) heats the widthwise reduced slab to a temperature suitable for the next rolling step. Between the sizing press (4) and the reheating oven (5), there is a transfer device (7) for transferring the width-reduced slab to the reheating oven, and a charging table (8) for charging the slab from the transfer device into the reheating oven. The rough rolling mills (6) serve to roll the reheated slab to a predetermined thickness. Between each rolling mill (6) there is a rough rolling table (11) for conveying or transferring the slab S which has been rolled in a preceding one of the two rough rolling mills (6). Crop shears and a finish rolling mill (not shown) are disposed at the outlet side of the rough rolling mill group.

In operation, the slab material which has been produced in the continuous casting apparatus (2), is cut to a predetermined length by a cutter (**2*a*) and then the resulting slab is conveyed to the simplified heating oven (3**) while it is kept at high temperature. In the simplified heating oven (3), each slab is heated by burners (3*a*). Thus, the side edge portions of the slab, which would otherwise drop in temperature, are prevented from experiencing a temperature drop. The reduced temperature of the slab is raised to the original temperature of the side edge portions of the slab, whereby the respective temperatures of the slab interior, slab side edge portions and slab surface layers are made uniform. Since the heating in the simplified heating oven (3) is effected by utilizing the latent heat in a solidified piece of the slab material produced in the continuous casting apparatus (2), only a small amount of heat input is necessary to sufficiently serve the purpose. The slab S thus heated is transferred to the sizing press (4) by of table rollers (3*b*). In the sizing press (4), the slab S is transferred to, and positioned at, a zone of molding (4*a*) by pinch rollers (4*d*). Then, electric motors (4*b*) rotate to drive eccentric shafts (4*c*). As a result, a pair of molding parts (4*a*) are moved in a direction transverse to the travelling direction of the slab S at right angles thereto for pressing the slab S and reducing its width. It is to be noted that each mold part (4*a*) has, as shown in FIG. 1A, an inclined portion (4*a*') inclined with respect to the travelling direction of the slab S and a parallel portion (4*a*'') parallel to the travelling direction of the slab S. Since the slab S is prevented from dropping in temperature at its side edge portions in the simplified heating oven (3), even when it is reduced in width by the sizing press (4), its side edge portions are prevented from cracking. Accordingly, it is possible to set the width dimension at any given value, thus performing an effective width reduction of the slab.

The side edge portions of the slab S, which have contacted the mold parts (4*a*) in the sizing press (4), are cooled and thus their temperatures are lowered. The slab S thus lowered in temperature is placed on transfer beams (7*a*) of the transfer device (7) and is conveyed to the charging table (8). Thus, the slab is placed on the charging table (8*a*) and is then put into the reheating oven (5). In the reheating oven (5), the side edge portions of the slab S are reheated to make the temperature of the slab S uniform. The amount of heat to be input as well as the time length of heating in the reheating oven (5), may also be small because the interior of the slab is kept at a high temperature and it suffices to reheat only the side edge portions of the slab.

The slab S thus reheated in the reheating oven (5) is transferred to the rough rolling mills (6) by a drawing table (9). Between the rough rolling mills (6), the slab S is conveyed on a rough rolling table (11). Thus, the slab S is rolled to a predetermined thickness by the rough rolling mills (6). At this time, the side edge portions of the slab, which have dropped in temperature in the sizing press (4), have already been completely restored to their original temperature by reheating in the reheating oven (5), so that the slab temperature is made uniform. For this reason, side edge cracks of the slab due to the temperature drop at the side edge portions do not occur. In addition, the decrease in precision of thickness in the widthwise direction (tendency for a central part of slab to extend in excess) can also be suppressed. This makes it possible to prepare a slab with no side edge cracks as well as with a uniform thickness.

The steel sheet thus prepared by being passed through the rough rolling mills (6) is conveyed to the succeeding rolling step including finish rolling mills.

According to this embodiment, since the simplified heating oven is installed immediately after the outlet of the continuous casting apparatus, the temperature drop at the side edge portions of the high temperature slab material produced in the continuous casting apparatus is prevented or compensated for by reheating, so that it is possible to directly reduce the width of the high temperature slab by the sizing press. Therefore, in the hot-rolling equipment provided with the sizing press, it becomes possible to effect hot direct rolling by directly connecting the rough rolling mills to the continuous casting apparatus. In addition, since the reheating oven is installed at the outlet side of the sizing press, it is possible to make the temperature of the slab cooled at its side edge portions by its contact with the press tool uniform and thereby prevent the occurrence of cracks at the side edge portions of the slab in the rolling step executed with use of the rough rolling mills, thus ensuring a slab with a uniform thickness. In addition, since the method of rolling is hot direct rolling, the amount of heat required and length of time required in the reheating oven can be greatly reduced as compared with the conventional heating oven. In addition, since the simplified heating oven is arranged so as to reheat or heat the slab by utilizing the latent heat in a solidified piece of the high-temperature slab material produced in the continuous casting apparatus, the amount of heat to be input in the simplified heating oven may also be small. This enables a reduction in size of the equipment and, at the same time, a reduction in cost of the equipment and reduction in the required energy.

Figure 2A:
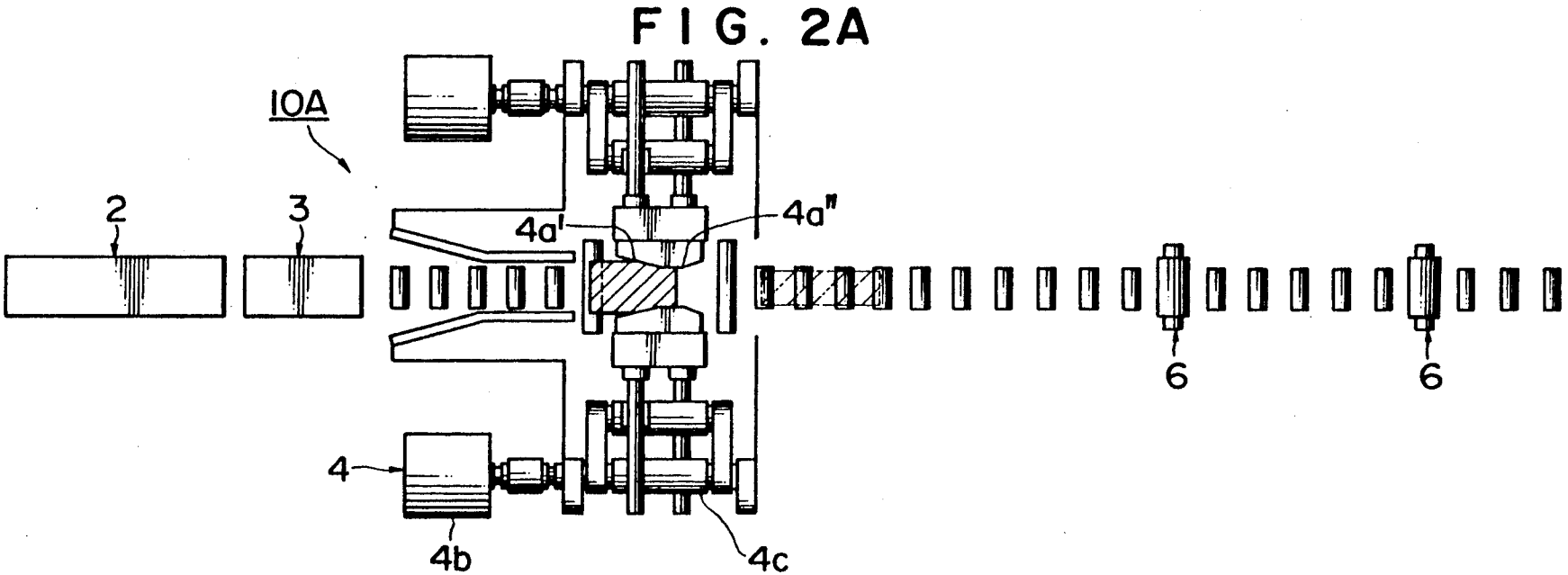
FIG. 2A is a plan view of the hot-rolling equipment constructed in accordance with a second embodiment of the present invention.
Figure 2B:
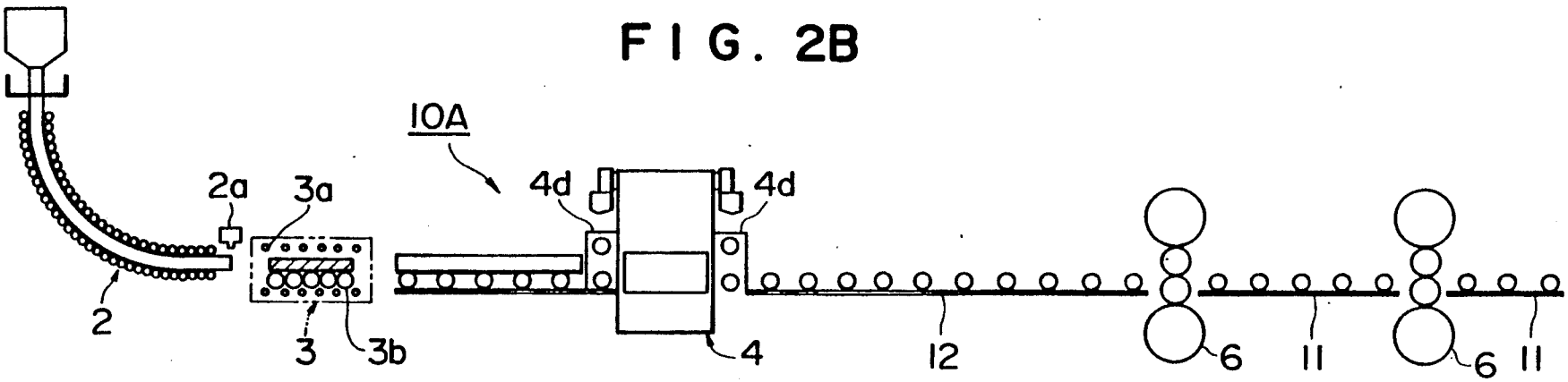
FIG. 2B is a side view of the hot-rolling equipment shown in FIG. 2A.

A second embodiment of the present invention will now be described with reference to FIGS. 2A and 2B. While the hot-rolling equipment (10A) according to the first embodiment permits the performance of both hot direct rolling (HDR) and hot charge rolling (HCR), the hot-rolling equipment constructed in accordance with the second embodiment permits the performance of the direct rolling (HDR) only. As shown in FIGS. 2A and 2B, the hot-rolling equipment (10A) according to the second embodiment does not include the reheating oven (5) and the transfer units (7, 8 and 9) at the inlet and outlet sides thereof present in the first embodiment. A conveyance table (12) is disposed immediately after the outlet of the sizing press (4) and a plurality of rough rolling mills (6) are disposed immediately after an outlet of this conveyance table (12).

In operation, in the hot-rolling equipment (10A) according to the second embodiment, the high-temperature slab material produced in the continuous casting apparatus (2) is transferred while kept at high temperature to the simplified heating oven (3) after being cut to a suitable length by the cutter (2*a*). This simplified heating oven (3) not only prevents the temperature drop at the side edge portions of the slab S by making the respective temperatures of the interior, side edge portions and surface layers of the slab S uniform by reheating, but also is so arranged that, by estimating in advance the temperature drop during the reduction in width by the sizing press (4), the slab may be heated in advance by a temperature portion corresponding to such temperature drop. The slab S heated by this simplified heating oven (3) is tranferred to the sizing press (4) and is narrowed to a predetermined width and thereafter is transferred to the succeeding rough rolling mills (6). Thus, the slab S is rolled to a predetermined thickness.

As above described, in the second embodiment, with a temperature drop due to passage through the sizing press (4) being estimated in advance, the slab S is heated beforehand in the simplified heating oven (3) by a temperature corresponding to such temperature drop. Accordingly, even when the reduction in width has been effected by the sizing press (4), the side edge portions of the slab S are kept in a condition of high temperature. Accordingly, it is possible to prevent the occurrence of any side edge crack of the slab during the rolling operation. Simultaneously, since the slab as a whole is kept in a condition of high temperature, it is possible to control the shape of the slab in the rough rolling mills (6), thereby ensuring a uniform thickness of the slab with high precision.

According to the second embodiment, the amount of heat to be input in the simplified heating oven is indeed increased. However, since the second embodiment does not include the reheating oven and transferring units such as those stated in the first embodiment, reduction in energy can be expected. In addition, reduction in scale of the equipment can be achieved and it is possible to greatly reduce the equipment cost.

In connection with the first embodiment, explanation has been made of the flow of the hot charge rolling (HCR) employing the reheating oven. In the second embodiment as well, it is possible to directly transfer a slab that has been width-reduced by the sizing press to the rough rolling mills and roll the slab without employing the reheating oven depending upon the circumstances, and by heating the slab in advance in the simplified heating oven by a temperature corresponding to the temperature drop of the slab S in the sizing press.

According to the present invention, since the high temperature slab material produced in the continuous casting apparatus is directly reduced in width by the sizing press, improved rolling with no edge cracking of the slab becomes possible. Further, since the direct transfer rolling in which the steel-making step is directly connected to the rolling step is carried out, not only the production process of the creation of steel to a product, but also the facilities can be reduced in scale. In addition, reduction in cost of the facilities becomes possible and energy savings can be obtained by utilizing the high temperature of a cast piece of base material.

What is claimed is:

1. In a hot-rolling equipment installation including a sizing press for reducing the width of a slab having a width that is substantially greater than its height, said sizing press including opposed tool portions that reduce the width of the slab by reciprocating laterally with respect to the traveling direction of the slab to press it in the widthwise direction, the sizing press being disposed at the inlet side of rough rolling mills, and the slab material being supplied from a continuous casting apparatus and rolled in the rough rolling mills after being passed through the sizing press, the improvement comprising a simplified heating oven disposed immediately after an outlet of said continuous casting apparatus, said sizing press being disposed immediately after an outlet of said simplified heating oven; and said continuous casting apparatus, simplified heating oven, reciprocating sizing press and rough rolling mills being arranged in a linear manner, whereby the high temperature slab material produced in said continuous casting apparatus is subjected to reduction in width by said reciprocating sizing press after being heated in said simplified heating oven, wherein said simplified heating oven includes means for raising the temperature of edge portions of the slab higher than the temperature of a center portion of the slab.

2. The hot rolling equipment as claimed in claim 1, further comprising a reheating oven disposed at an outlet side of said sizing press, and where said rough rolling mills are disposed at an outlet side of said reheating oven.

3. The hot-rolling equipment as claimed in claim 1, in which said rough rolling mills are disposed immediately after an outlet side of said sizing press.

4. The hot-rolling equipment as claimed in claim 1, in which said sizing press has a pair of mold parts for pressing said slab by their lateral reciprocating movements with respect to the travelling direction of said slab, said pair of mold parts being so arranged as to contact with said slab having first surface portions converging in the travelling direction of said slab and second surface portions parallel to the travelling direction of said slab.

5. The hot-rolling equipment installation as claimed in claim 1, further comprising cutter means located at the outlet of said continuous casting apparatus for cutting the slab material into slabs of a predetermined length.

6. A hot-rolling method for hot-rolling a slab of a slab material having a width that is substantially greater than its height cast from a continuous casting apparatus by using hot-rolling equipment including a sizing press of the type including opposed tool portions that reduce the width of the slab material by reciprocating laterally with respect to the traveling direction of the slab material to press it in the widthwise direction, and rough rolling mills, comprising the steps of heating said slab material received from said continuous casting apparatus in a simplified heating oven disposed immediately after an outlet of said continuous casting apparatus, including raising the temperature of edge portions of the slab higher than the temperature of a center portion of the slab, and contracting and reducing the width of said heated slab by said reciprocating sizing press disposed immediately after an outlet of said simplified heating oven.

7. The hot-rolling method as claimed in claim 6, further comprising the step of rolling said width-contracted and reduced slab to a predetermined thickness in said rough rolling mills.

8. The hot-rolling method as claimed in claim 6, further comprising the steps of reheating said width-contracted and reduced slab in a simplified heating oven, and rolling said reheated slab to a predetermined thickness in said rough rolling mills.

9. A hot-rolling method as claimed in claim 6, further comprising the step, after the step of heating said slab material, of cutting said slab material into a plurality of slabs at the outlet of said continuous casting apparatus.

* * * * *